US005322449A

United States Patent [19]

Pizano

[11] Patent Number: 5,322,449

[45] Date of Patent: Jun. 21, 1994

[54] TRIPLE NEMA STANDARD POWER PLUG RECEPTACLE

[76] Inventor: Marcello R. Pizano, 5948 Vista Loop, San Jose, Calif. 95124-6562

[21] Appl. No.: 165,189

[22] Filed: Dec. 13, 1993

[51] Int. Cl.[5] ..... H01R 27/00

[52] U.S. Cl. ..... 439/222

[58] Field of Search ..... 439/218, 222, 223, 220, 439/221, 217

[56] References Cited

U.S. PATENT DOCUMENTS 4,726,780 2/1988 Thakerlay ..... 439/223

4,900,270 2/1990 Edward et al. ..... 439/223

5,007,848 4/1991 Lee ..... 439/223

*Primary Examiner*—Gary F. Paumen

[57] ABSTRACT

The combination of three NEMA-Standard receptacle patterns provides for a compact multi-purpose power receptacle. The triple NEMA-Standard receptacle reduces the need for different types of outlets and extension cords depending in the power plug on the electrical tool. A refined arrangement of contacts in the triple NEMA-Standard receptacle combines three types of interconnects in the space of one receptacle.

4 Claims, 3 Drawing Sheets

TRIPLE NEMA STANDARD POWER PLUG RECEPTACLE

The present invention relates to an electrical power plug connector with different NEMA standard plugs including twist lock connectors. Twist lock connectors are used to interconnect and to secure the electrical connection at construction sites and where an unexpected disconnection of a power tool may cause problems. However, not all power tools used at such sites are equipped with twist lock connectors by the original tool manufacturer. Thus, there is a need for use of interconnecting receptacles between a twist lock receptacle and a regular non-twist lock male plug of a tool. The use of separate receptacles or receptacle extension cords with non-matching plug and receptacle connection components increases the inventory of potentially needed electrical components and may delay progress if not available when needed.

The present invention overcomes these and other disadvantages by combining the most often used twist lock connector pattern with two of the most often used non-twist lock connector patterns in one power plug receptacle. The principle is applicable in combination with a receptacle in a mounting box as well as with a female connector of an extension cord.

SUMMARY OF THE INVENTION

It is an object of the present invention to provide for a female power plug receptacle for two and three-electrode male plugs of different configurations.

It is another object of this invention to eliminate the need for different supply extension cords for when interfacing with appliances having different standard male power plugs.

It is another object of the present invention to provide for a multi-standard power plug receptacle including a twist lock receptacle.

BRIEF DESCRIPTION OF THE INVENTION

Figure 1:
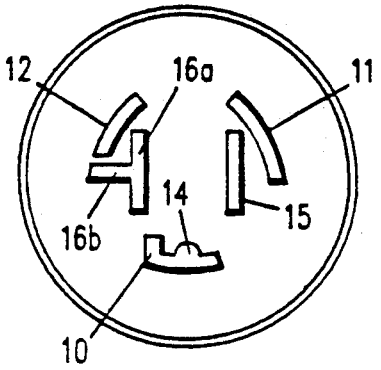
FIG. 1 is an illustration of the contact pattern of the plug receptacle of the present invention.

FIG. 1 is an illustration of the contact pattern of the plug receptacle of the present invention. There are three NEMA standards supported by this receptacle. The twist lock pattern includes openings or slots 10, 11 and 12. All slots of the twist lock pattern are arranged in a circle. Slot 10 receives the L-shaped reference contact blade, the long side of the "L" being a section of the circle shared with openings 11 and 12 as mentioned before. This L-shaped reference contact blade by NEMA standard definition is ground connected. The size of the slots provides for sufficient clearance to insert the contact blades of the male connector and to apply the rotational twist of the male connector relative to the female connector to provide for the locking connection.

Reference opening 10 includes a round opening section 14 overlapping with the circular opening 10 for receiving reference or ground contact blade of other connector patterns.

Opening or slot 15 is common to two NEMA standard connector patterns. Opening 16 consist of a larger section **16*a* which is provided for receiving a contact blade of a connector according to NEMA standard 5-15, and a smaller section 16*b* which is provided for receiving a contact blade of a connector according to NEMA standard 5-20. Slot section 16*b* intersects the center of slot 16*a*** at a right angle.

The arrangement can also receive in slots 15 and **16*a*** power plugs with two parallel contacts and no ground contact.

Figure 2:
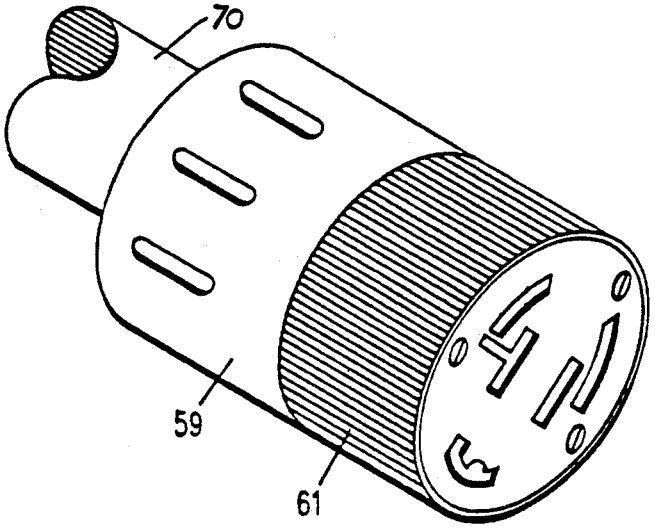
FIG. 2 is an illustration of a female power connector of an electrical extension cord.
Figure 4:
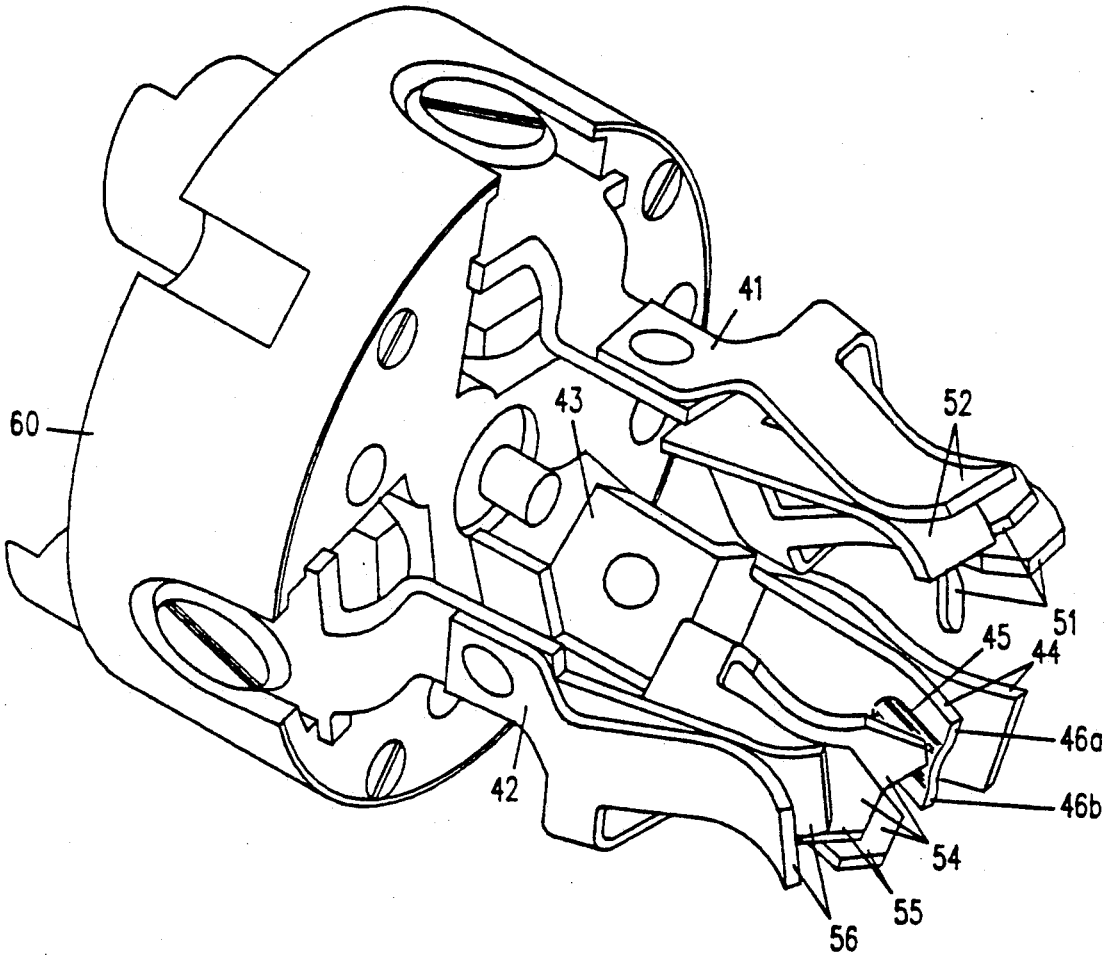
FIG. 4 is a perspective view of the contact armatures of the female power connector of an electrical extension cord.
Figure 5A:
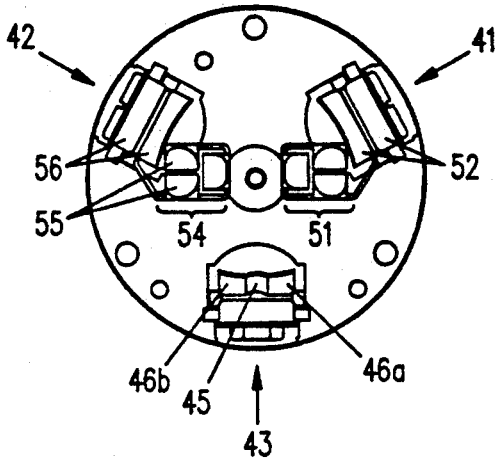
FIGS. 5A through 5D are schematic illustrations of the contact armatures and the main body of the power connector.
Figure 5B:
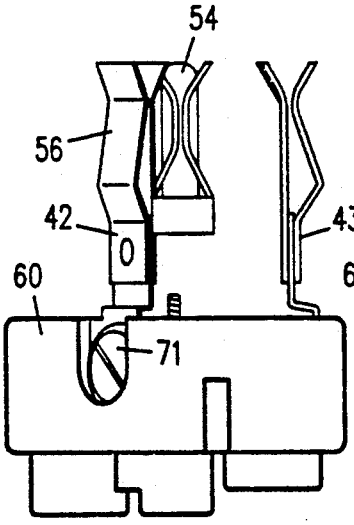
Figure 5C:
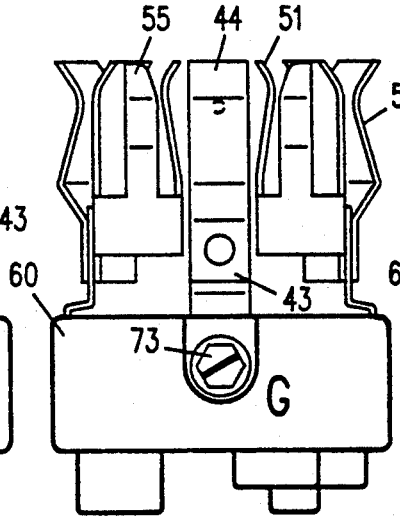
Figure 5D:
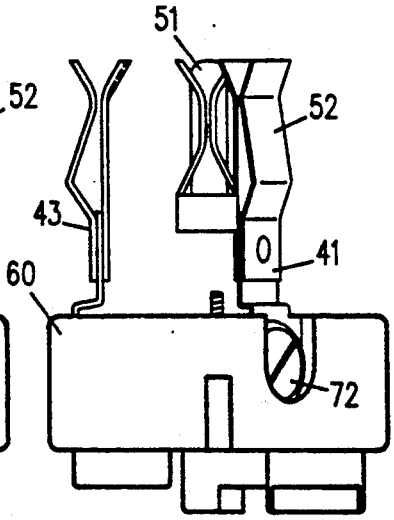

FIG. 2 is an illustration of a receptacle of a power cord 70 which receptacle can receive power plugs of the three NEMA standards 5-15, 5-20 and L5-20. The extension cord receptacle consists of a base cover 59, a header 61 including the slots and openings for receiving contact blades of a male plug, and an internally mounted body 60, which is shown in FIG. 4. Header 61 is attached to body 60 by use of screws or clamps in any one of several well known ways. Body 60 may include a clamp for holding the cable, and it holds the contact armatures in recesses as shown in FIG. 4.

Figure 3:
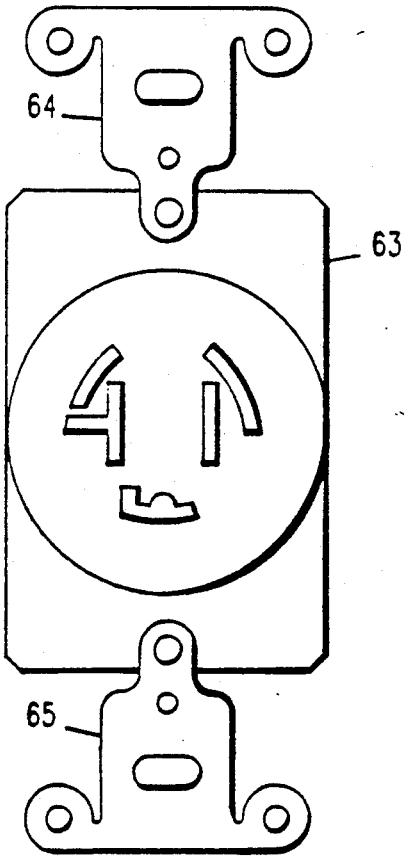
FIG. 3 is a front view illustration of a wall box mountable female power plug receptacle of the present invention.

FIG. 3 is a front view illustration of an electrical box mountable female power plug receptacle of the present invention. The mountable power plug receptacle is similar in construction to the extension cord plug but does not need a form supporting easy manual handling during making a connection with a male plug. However, receptacle body 63 includes mounting brackets 64 and 65 for mounting the receptacle inside a suitable electrical box.

FIG. 4 is an illustration of the arrangement of contacts inside a receptacle of an extension cable. There are three connection armatures 41, 42 and 43. Armature 43 is located behind slot or opening 10 of the pattern of FIG. 1. It can receive either the locking ground contact blade of a NEMA standard L5-20 plug connector or a ground contact of power plugs of NEMA standards 5-15 or 5-20. To receive ground contacts of the later standards the inner contact blade 46 of armature 43 has a semi-circular indenture 45. Contact sections **46*a* and 46*b* of blade 46** are provided to make contact with an inserted contact blade of a NEMA standard L5-20 ground contact blade.

Armatures 41 and 42 consist of two sections. Armature 41 is located behind slots 11 and 15. Armature 42 is located behind slots 12 and 16. Armature 41 consists of a section 52 for receiving the contact blade of a twist-lock plug connector, and a section 51 for receiving a straight blade of a NEMA standard 5-15 or 5-20 power plug. Armature 42 consists of three sections 54, 55 and 56. Section 56 receives the contact blade of a twist-lock connector. Section 54 receives the contact blade of a NEMA standard 5-15 power plug. Section 55 receives the contact blade of a NEMA standard 5-20 power plug.

Armatures 41, 42 and 43 held in place in connector body 60 Each of the armatures 41, 42 and 43 has provisions for making secure contact with a wire or cable strand by either a contact screw as shown in FIG. 4 or by other well known and accepted means to secure an electrical supply line to a contact armature. A header 61 with proper openings for receiving the armatures completes the receptacle and is secured to body 60 by screws (not shown). Header 61 includes the necessary recesses to receive the locking tongue of the ground contact blade of the male twist lock connector.

Wall receptacle shown in FIG. 3 may use the very same type of armatures and may be assembled in a similar fashion as shown for extension cord receptacle in FIG. 4.

FIGS. 5A through 5D are schematic illustrations of the contact armatures 41 42 and 43 as they are mounted in connector body 60 of the power connector. Armature 41 connects to the neutral power line, armature 42 connects to the "hot" line, and armature 43 connects to the GROUND connection.

Each of the armatures 41, 42, 43 is separately embedded in connector body 60. Each of the armatures 41, 42, 43 has means for connecting to a wire of a power cable. In FIGS. 5A through 5D the connection to the wires is established by contact screws 71, 72, and 73, respectively.

Armature 43 receives either a round contact or an arc shaped knife contact. The arc shaped knife contact may include an extension pointing to the center of the contact arrangement. Armature 43 has two contact blades which are shaped to provide functional contact to either a knife contact or a round contact.

Armature 41 includes five contact blades arranged in three pairs. One pair of contact blades 51 receives a knife contact reaching through opening 15 of the contact pattern of FIG. 1. The other pair of contacts 52 receives an arc shaped knife contact reaching through opening 11 of the contact pattern of FIG. 1.

Armature 42 includes five contact blades arranged in three pairs. A first pair of contact blades 54 receives a knife contact reaching through opening 16*a* of the contact pattern of FIG. 1. The second first pair of contact blades 55 receives a knife contact reaching through opening 16*b* of the contact pattern of FIG. 1. The third pair of contacts 56 receives an arc shaped knife contact reaching through opening 12 of the contact pattern of FIG. 1.

In FIGS. 5A through 5D armatures 41 and 42 are shown as mirror images each having three pairs of contact blades. However, in the position of armature 41 only two pairs are used.

What I claim is:

1. A multi-NEMA-standard power cord receptacle for receiving male power plug connectors comprising:

a front piece having openings for receiving contact blades or pins of different NEMA standard male power plugs including a first arrangement of three openings angularly spaced apart for receiving contact blades of a twist-lock power connector, a second arrangement of three openings including two parallel spaced apart straight openings and a third round opening intersecting one of said openings of said first arrangement of openings, and a third arrangement of openings sharing two openings with said second arrangement of openings and having a third opening normally intersecting the third opening of said second arrangement, wherein said second and said third arrangements are located inside a circle determined by said first arrangement of openings, contact armatures including first, second and third armatures, and a mounting body for said contact armatures, said first armature adapted to receive selectively a curved contact blade or a round contact pin, said first armature being the ground contact armature of said plug receptacle, said second armature including a first section for receiving a curved contact blade and a second section for receiving a straight contact blade, said third armature including a first section for receiving a curved contact blade, a second section for receiving a straight contact blade being oriented in parallel to said second section of said second armature, and a third section for receiving a straight contact blade being normally oriented to said second section of said second armature, said first, second, and third armatures including means for securing and connecting an electrical wire to said armature, said mounting body including means for receiving said front piece and securing said front piece to said mounting body, said front piece providing an insulating cover over and between said armatures except for said openings for receiving said contact blades or contact pins of said male power plugs.

2. An electrical power box mountable outlet socket for receiving power plug connectors of several different NEMA configurations comprising:

a front piece having openings for receiving contact blades or pins of different NEMA standard power plug configurations including a first arrangement of three openings angularly spaced apart for receiving contact blades of a twist-lock power connector, said openings being arcs on a common circle; a second arrangement of three openings including two parallel spaced apart straight openings and a third opening for receiving a round or U-shaped contact pin, said third opening intersecting one of said openings of said first arrangement of openings; and a third arrangement of openings sharing one of said two parallel straight openings and said third opening with said second arrangement, and having an opening substantially normal to the other one of said parallel straight opening of said second arrangement, wherein said second and said third arrangements are located inside a circle determined by said first arrangement of openings;

contact armatures including first, second and third armatures, and a mounting body for said contact armatures, said first armature adapted to receive selectively a curved contact blade or a round contact pin, said second armature including a first section for receiving a curved contact blade and a second section for receiving a straight contact blade, said third armature including a first section for receiving a curved contact blade, a second section for receiving a straight contact blade being oriented in parallel to said second section of said second armature, and a third section for receiving a straight contact blade being normally oriented to said second section of said second armature, said first, second, and third armatures including means for securing and connecting an electrical wire to said armature, said mounting body including means for receiving said front piece and means for securing said front piece to said mounting body, said front piece providing an insulating cover over and between said armatures except for said openings for selectively receiving said contact blades or contact pins of said power plugs of said several NEMA configurations.

3. A multi-NEMA-standard power cord plug receptacle for receiving NEMA standard male power plug connectors comprising:

a NEMA 5-15 standard receptacle, a NEMA 5-20 standard receptacle, and a NEMA L5-20 standard receptacle;

said receptacle having a common armature for receiving ground contacts of said power plugs; and wherein each of said standard receptacles shares at least one opening with another of said standard receptacles.

4. A multi-NEMA-standard electrical box mounted power outlet for receiving NEMA standard male power plug connectors comprising:

a NEMA 5-15 standard receptacle, a NEMA 5-20 standard receptacle, and a NEMA L5-20 standard receptacle;

said receptacle having a common armature for receiving ground contacts of said power plugs; and wherein each of said standard receptacles shares at least one opening with another of said standard receptacles.

* * * * *